US009538289B2

(12) United States Patent
Karkkainen et al.

(10) Patent No.: US 9,538,289 B2
(45) Date of Patent: *Jan. 3, 2017

(54) CONTROL PARAMETER DEPENDENT AUDIO SIGNAL PROCESSING

(71) Applicant: Nokia Technologies Oy, Espoo (FI)

(72) Inventors: Asta M. Karkkainen, Helsinki (FI); Jussi Virolainen, Espoo (FI)

(73) Assignee: Nokia Technologies Oy, Espoo (FI)

( * ) Notice: Subject to any disclaimer, the term of this patent is extended or adjusted under 35 U.S.C. 154(b) by 0 days.

This patent is subject to a terminal disclaimer.

(21) Appl. No.: 14/863,745

(22) Filed: Sep. 24, 2015

(65) Prior Publication Data

US 2016/0014517 A1 Jan. 14, 2016

Related U.S. Application Data

(63) Continuation of application No. 13/511,645, filed as application No. PCT/EP2009/066080 on Nov. 30, 2009, now Pat. No. 9,185,488.

(51) Int. Cl.

| | |
|---|---|
| ***H04R 3/00*** | (2006.01) |
| ***H04R 5/04*** | (2006.01) |
| ***H04R 1/40*** | (2006.01) |
| ***H04R 5/033*** | (2006.01) |
| ***H04S 1/00*** | (2006.01) |

(52) U.S. Cl.

CPC ..... *H04R 5/04* (2013.01); *H04R 1/406* (2013.01); *H04R 3/005* (2013.01); *H04R 5/033* (2013.01); *H04S 1/007* (2013.01); *H04R 2201/403* (2013.01); *H04R 2203/12* (2013.01);

(Continued)

(58) Field of Classification Search

None

See application file for complete search history.

(56) References Cited

U.S. PATENT DOCUMENTS

| | | | | |
|---|---|---|---|---|
| 4,741,038 | A | 4/1988 | Elko et al. | 381/92 |
| 6,035,047 | A | 3/2000 | Lewis | 381/72 |

(Continued)

FOREIGN PATENT DOCUMENTS

| | | | |
|---|---|---|---|
| DE | 202007018768 | U1 | 4/2009 |
| EP | 1224837 | A2 | 7/2002 |

(Continued)

OTHER PUBLICATIONS

Donovan, et al., "Spherical Microphone Array Based Immersive Audio Scene Rendering", Proceedings of the 14th International Conference on auditory Display, Jun. 24-27, 2008, pp. 1-8.

(Continued)

*Primary Examiner* — Fan Tsang
*Assistant Examiner* — Angelica M McKinney
(74) *Attorney, Agent, or Firm* — Harrington & Smith

(57) ABSTRACT

An apparatus comprising at least one processor and at least one memory including computer program code the at least one memory and the computer program code configured to, with the at least one processor, cause the apparatus at least to perform processing at least one control parameter dependent on at least one sensor input parameter, processing at least one audio signal dependent on the processed at least one control parameter, and outputting the processed at least one audio signal.

23 Claims, 6 Drawing Sheets

(52) U.S. Cl.
CPC ..... *H04R 2460/01* (2013.01); *H04S 2400/13* (2013.01); *H04S 2400/15* (2013.01)

(56) References Cited

U.S. PATENT DOCUMENTS

| | | | | |
|---|---|---|---|---|
| 6,150,044 | A | 11/2000 | Goldstein et al. | 381/57 |
| 6,518,889 | B2 * | 2/2003 | Schlager | B63C 9/0005 340/438 |
| 7,173,525 | B2 | 2/2007 | Albert | 340/521 |
| 7,221,260 | B2 | 5/2007 | Berezowski et al. | 340/286.05 |
| 7,352,871 | B1 | 4/2008 | Mozo | 381/72 |
| 7,401,519 | B2 | 7/2008 | Kardous | 381/646 |
| 8,068,025 | B2 | 11/2011 | Devenyl et al. | 340/540 |
| 8,081,765 | B2 | 12/2011 | Yu | 381/57 |
| 8,150,044 | B2 | 4/2012 | Goldstein et al. | 381/57 |
| 8,270,629 | B2 | 9/2012 | Bothra et al. | 381/74 |
| 8,913,758 | B2 * | 12/2014 | Levi | H04R 3/005 381/92 |
| 8,981,994 | B2 * | 3/2015 | Sorenson | G10K 11/34 342/368 |
| 9,185,488 | B2 * | 11/2015 | Karkkainen | H04R 3/005 |
| 2007/0085157 | A1 * | 4/2007 | Fadell | G06F 3/0304 257/428 |
| 2008/0008327 | A1 | 1/2008 | Ojala et al. | 381/20 |
| 2008/0008341 | A1 | 1/2008 | Edwards | 381/315 |
| 2008/0056457 | A1 | 3/2008 | Hsu | |
| 2008/0079571 | A1 | 4/2008 | Samadani | 340/552 |
| 2008/0159178 | A1 | 7/2008 | Syrjanen et al. | 370/261 |
| 2008/0165988 | A1 | 7/2008 | Terlizzi et al. | |
| 2008/0177507 | A1 | 7/2008 | Mian et al. | |
| 2008/0259731 | A1 | 10/2008 | Happonen | |
| 2008/0285772 | A1 | 11/2008 | Haulick et al. | 381/92 |
| 2009/0268931 | A1 | 10/2009 | Andrea et al. | 381/311 |
| 2010/0328419 | A1 | 12/2010 | Etter | 348/14.08 |
| 2011/0106627 | A1 | 5/2011 | LeBoeuf et al. | 705/14.66 |

FOREIGN PATENT DOCUMENTS

| | | | |
|---|---|---|---|
| EP | 1575250 | A1 | 9/2005 |
| EP | 1795041 | A2 | 6/2007 |
| EP | 2002438 | A2 | 12/2008 |
| EP | 2002687 | A1 | 12/2008 |
| GB | 2436657 | A | 10/2007 |
| WO | WO-01/37435 | A2 | 5/2001 |
| WO | WO-2006/026812 | A2 | 3/2006 |
| WO | WO-2007/110807 | A2 | 10/2007 |
| WO | WO-2008/124786 | A2 | 10/2008 |
| WO | WO-2009/034524 | A1 | 3/2009 |

OTHER PUBLICATIONS

Casey, et al., "Vision Steered Beam-forming and Transaural Rendering for the Artificial Life Interactive Video Environment", Proceedings of the Audio Engineering Society 99$^{th}$ Conference, Nov. 1995, pp. 1-28.

* cited by examiner

CONTROL PARAMETER DEPENDENT AUDIO SIGNAL PROCESSING

CROSS REFERENCE TO RELATED APPLICATIONS

This is a continuation application of copending application Ser. No. 13/511,645 filed May 23, 2012, which is a national stage application of International Application No. of PCT/EP2009/066080 filed Nov. 30, 2009, which are hereby incorporated by reference in their entireties.

The present invention relates to apparatus for processing of audio signals. The invention further relates to, but is not limited to, apparatus for processing audio and speech signals in audio devices.

Augmented reality, where the users own senses are 'improved' by the application of further sensor data, is a rapidly developing topic of research. For example the use of audio, visual or haptic sensors to receive sound, video and touch data which may be passed to processors to be processed and then outputting the processed data displayed to a user to improve or focus a user's perception of the environment has become a hotly researched topic. One augmented reality application in common use is where audio signals are captured using an array of microphones, the captured audio signals may then be inverted then output to the user to improve the user's experience. For example in active noise cancelling headsets or ear-worn speaker carrying devices (ESD) this inversion may be output to the user thus reducing the ambient noise and allowing the user to listen to other audio signals at a much lower sound level then would be otherwise possible.

Some augmented reality applications may carry out limited context sensing. For example, some ambient noise cancelling headsets have been employed whereby on request from the user or in response to detecting motion, the ambient noise cancelling function of the ear-worn speaker carrying device may be muted or removed to enable the user to hear the surrounding audio signal.

In other augmented reality applications the limited context sensing may include detecting the volume level of the audio signals being listened to and muting or increasing the ambient noise cancelling function.

As well as ambient noise cancelling audio signal processing other processing of the audio signals is known. For example audio signals from more than one microphone may be processed to weight the audio signals and thus beamform the audio signals to enhance the perception of audio signals from a specific direction.

Although limited context controlled processing may be useful for ambient or generic noise suppression there are many examples where such limited context control is problematic or even counterproductive. For example in industrial or mining zones the user may wish to reduce the amount of ambient noise in all or some directions and enhance the audio signals for a specific direction the user wishes to focus on. For example operators of heavy machinery may need to communicate with each other but without the risk of ear damage caused by the noise sources surrounding them. Furthermore the same users would also appreciate being able to sense when they were in danger or potential danger in such environments without having to removing their headsets and thus potentially exposing themselves to hearing damage.

This invention proceeds from the consideration that detection from sensors may be used to configure or modify the configuration of the audio directional processing to thus improve the safety of the user in various environments.

Embodiments of the present invention aim to address the above problem.

There is provided according to a first aspect of the invention a method comprising: processing at least one control parameter dependent on at least one sensor input parameter; processing at least one audio signal dependent on the processed at least one control parameter; and outputting the processed at least one audio signal.

The method may further comprise generating the at least one control parameter dependent on at least one further sensor input parameter.

Processing at least one audio signal may comprise beamforming the at least one audio signal and the at least one control parameter may comprise at least one of: a gain and delay value; a beamforming beam gain function; a beamforming beam width function; a beamforming beam orientation function; and a perceived orientation beamforming gain and beam width parameter.

Processing at least one audio signal may comprise at least one of: mixing the at least one audio signal with at least one further audio signal; amplifying at least one component of the at least one audio signal; and removing at least one component of the at least one audio signal.

The at least one audio signal may comprise at least one of: a microphone audio signal; a received audio signal; and a stored audio signal.

The method may further comprise receiving at least one sensor input parameter, wherein the at least one sensor input parameter may comprise at least one of: motion data; position data; orientation data; chemical data; luminosity data; temperature data; image data; and air pressure.

Processing at least one control parameter dependent on at least one sensor input parameter may comprise modifying the at least one control parameter on determining whether the at least one sensor input parameter is greater or equal to at least one predetermined value.

Outputting the processed at least one output signal may further comprise: generating a binaural signal from the processed at least one audio signal; and outputting the binaural signal to at least an ear worn speaker.

According to a second aspect of the invention there is provided an apparatus comprising at least one processor and at least one memory including computer program code the at least one memory and the computer program code configured to, with the at least one processor, cause the apparatus at least to perform: processing at least one control parameter dependent on at least one sensor input parameter; processing at least one audio signal dependent on the processed at least one control parameter; and outputting the processed at least one audio signal.

The at least one memory and the computer program code is preferably configured to, with the at least one processor, cause the apparatus to further perform: generating the at least one control parameter dependent on at least one further sensor input parameter.

Processing at least one audio signal may cause the apparatus at least to perform beamforming the at least one audio signal and the at least one control parameter may comprise at least one of: a gain and delay value; a beamforming beam gain function; a beamforming beam width function; a beamforming beam orientation function; and a perceived orientation beamforming gain and beam width parameter.

Processing at least one audio signal may cause the apparatus at least to perform at least one of: mixing the at least one audio signal with at least one further audio signal;

amplifying at least one component of the at least one audio signal; and removing at least one component of the at least one audio signal.

The at least one audio signal may comprise at least one of: a microphone audio signal; a received audio signal; and a stored audio signal.

The at least one memory and the computer program code is preferably configured to, with the at least one processor, cause the apparatus to further perform receiving at least one sensor input parameter, wherein the at least one sensor input parameter may comprise at least one of: motion data; position data; orientation data; chemical data; luminosity data; temperature data; image data; and air pressure.

Processing at least one control parameter dependent on at least one sensor input parameter preferably cause the apparatus at least to perform modifying the at least one control parameter on determining whether the at least one sensor input parameter is greater or equal to at least one predetermined value.

Outputting the processed at least one output signal may cause the apparatus at least to perform: generating a binaural signal from the processed at least one audio signal; and outputting the binaural signal to at least an ear worn speaker.

According to a third aspect of the invention there is provided an apparatus comprising: a controller configured to process at least one control parameter dependent on at least one sensor input parameter; and an audio signal processor configured to process at least one audio signal dependent on the processed at least one control parameter, wherein the audio signal processor is further configured to output the processed at least one audio signal.

The controller is preferably further configured to generate the at least one control parameter dependent on at least one further sensor input parameter.

The audio signal processor is preferably configured to beamform the at least one audio signal and the at least one control parameter may comprise at least one of: a gain and delay value; a beamforming beam gain function; a beamforming beam width function; a beamforming beam orientation function; and a perceived orientation beamforming gain and beam width parameter.

The audio signal processor is preferably configured to mix the at least one audio signal with at least one further audio signal.

The audio signal processor is preferably configured to amplify at least one component of the at least one audio signal.

The audio signal processor is preferably configured to remove at least one component of the at least one audio signal.

The at least one audio signal may comprise at least one of: a microphone audio signal; a received audio signal; and a stored audio signal.

The apparatus may comprise at least one sensor configured to generate the at least one sensor input parameter, wherein the at least one sensor may comprise at least one of: motion sensor; position sensor; orientation sensor; chemical sensor; luminosity sensor; temperature sensor; camera sensor; and air pressure sensor.

The controller is preferably further configured to process the at least one control parameter dependent on determining whether the at least one sensor input parameter is greater or equal to at least one predetermined value.

The audio signal processor configured to output the processed at least one audio signal is preferably configured to: generate a binaural signal from the processed at least one audio signal; and output the binaural signal to at least an ear worn speaker.

According to a fourth aspect of the invention there is provided an apparatus comprising: control processing means configured to process at least one control parameter dependent on at least one sensor input parameter; audio signal processing means configured to process at least one audio signal dependent on the processed at least one control parameter; and audio signal outputting means configured to output the processed at least one audio signal.

According to a fifth aspect of the invention there is provided a computer-readable medium encoded with instructions that, when executed by a computer perform: processing at least one control parameter dependent on at least one sensor input parameter; processing at least one audio signal dependent on the processed at least one control parameter; and outputting the processed at least one audio signal.

An electronic device may comprise apparatus as described above.

A chipset may comprise apparatus as described above.

An electronic device may comprise apparatus as described above.

A chipset may comprise apparatus as described above.

For better understanding of the present invention, reference will now be made by way of example to the accompanying drawings in which.

Figure 1:
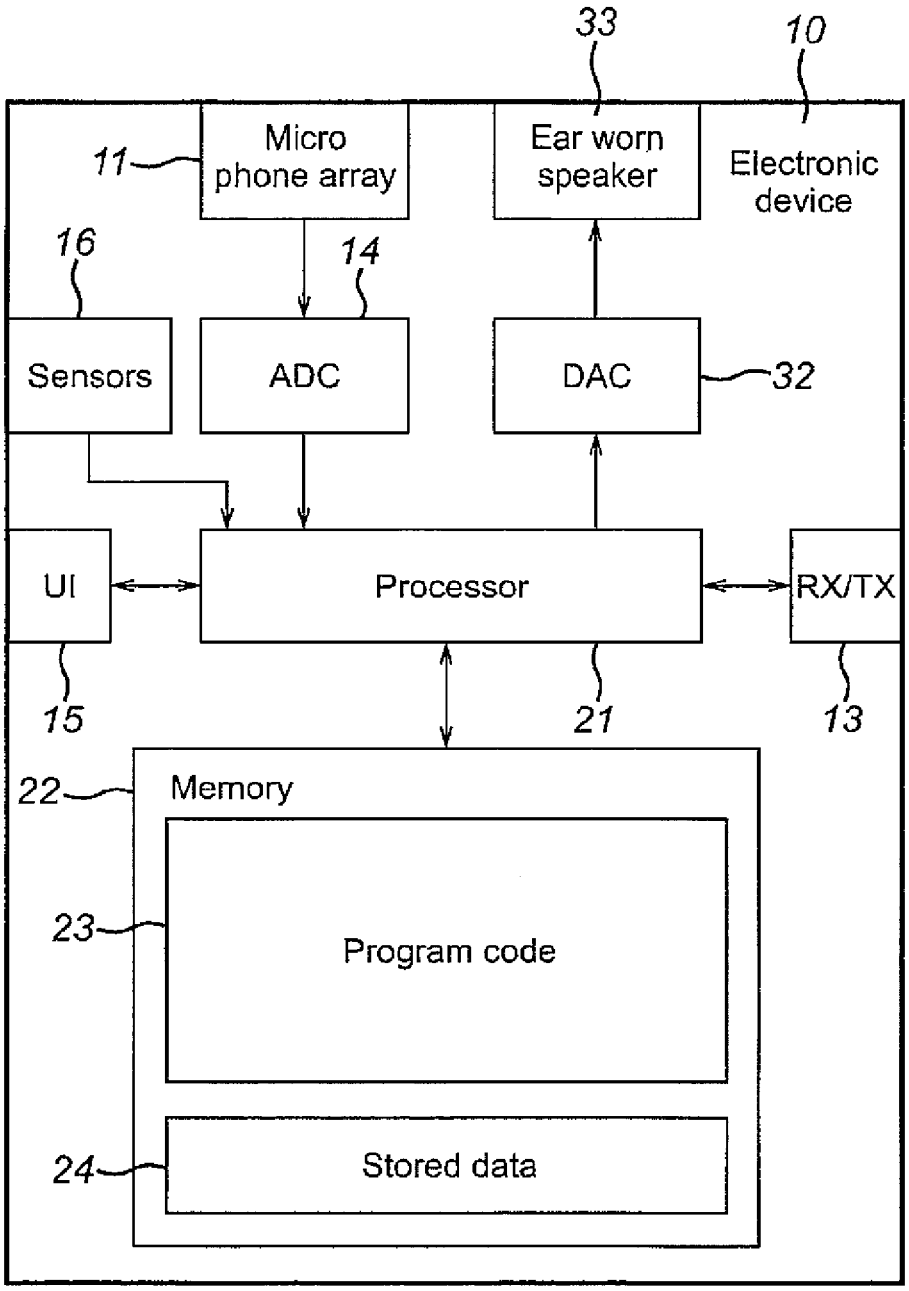
FIG. 1 shows schematically an electronic device employing embodiments of the application.

The following describes apparatus and methods for the provision of enhancing augmented reality applications. In this regard reference is first made to FIG. 1 schematic block diagram of an exemplary electronic device 10 or apparatus, which may incorporate an augmented reality capability.

The electronic device 10 may for example be a mobile terminal or user equipment for a wireless communication system. In other embodiments the electronic device may be any audio player (also known as mp3 players) or a media player (also known as mp4 players), or portable music player equipped with suitable sensors.

The electronic device 10 comprises a processor 21 which may be linked via a digital-to-analogue converter (DAC) 32 to an ear worn speaker (EWS). The ear worn speaker in some embodiments may be connected to the electronic device via a headphone connector. The ear worn speaker (EWS) may for example be a headphone or headset 33 or any suitable audio transducer equipment suitable to output acoustic waves to a user's ears from the electronic audio signal output from the DAC 32. In some embodiments the EWS 33 may themselves comprise the DAC 32. Furthermore in some embodiments the EWS 33 may connect to the electronic device 10 wirelessly via a transmitter or transceiver, for example by using a low power radio frequency connection such as Bluetooth A2DP profile. The processor 21 is further linked to a transceiver (TX/RX) 13, to a user interface (UI) 15 and to a memory 22.

The processor 21 may be configured to execute various program codes. The implemented program codes may in some embodiments comprise an augmented reality channel extractor for generating augmented reality outputs to the EWS. The implemented program codes 23 may be stored for example in the memory 22 for retrieval by the processor 21 whenever needed. The memory 22 could further provide a section 24 for storing data, for example data that has been processed in accordance with the embodiments.

The augmented reality application code may in embodiments be implemented in hardware or firmware.

The user interface 15 enables a user to input commands to the electronic device 10, for example via a keypad and/or a touch interface. Furthermore the electronic device or apparatus 10 may comprise a display. The processor in some embodiments may generate image data to inform the user of the mode of operation and/or display a series of options from which the user may select using the user interface 15. For example the user may select or scale a gain effect to set a datum level of noise suppression which may be used to set a 'standard' value which may be modified in the augmented reality examples described below. In some embodiments the user interface 15 in the form of a touch interface may be implemented as part of the display in the form of a touch screen user interface.

The transceiver 13 in some embodiments enables communication with other electronic devices, for example via cellular or mobile phone gateway servers such as Node B or base transceiver stations (BTS) and a wireless communication network, or short range wireless communications to the microphone array or EWS where they are located remotely from the apparatus.

It is to be understood again that the structure of the electronic device 10 could be supplemented and varied in many ways.

The apparatus 10 may in some embodiments further comprise at least two microphones in a microphone array 11 for inputting audio or speech that is to be processed, transmitted to some other electronic device or stored in the data section 24 of the memory 22 according to embodiments of the application. An application to capture the audio signals using the at least two microphones may be activated to this end by the user via the user interface 15. In some embodiments the microphone array may be implemented separately from the apparatus but communicate with the apparatus. For example in some embodiments the microphone array may be attached to or integrated within clothing. Thus in some embodiments the microphone array may be implemented as part of a high visibility vest or jacket and be connected to the apparatus via a wired or wireless connection. In such embodiments the apparatus may be protected by being placed within a pocket (which may in some embodiments be a pocket of the garment which comprises the microphone array) but still receive the audio signals from the microphone array. In some further embodiments the microphone array may be implemented as part of a headset or ear worn speaker system. At least one of the microphones may be implemented by an omnidirectional microphone in some embodiments. In other words these microphones may respond equally to sound signals from all directions. In some other embodiments at least one microphone comprises a directional microphone configured to respond to sound signals in predefined directions. In some embodiment at least one microphone comprises a digital microphone, in other words a regular microphone with an integrated amplifier and sigma delta type A/D converter in one component block. The digital microphone input may in some embodiments be also utilized for other ADC channels such as transducer processing feedback signal or for other enhancements such as beamforming or noise suppression.

The apparatus 10 in such embodiments may further comprise an analogue-to-digital converter (ADC) 14 configured to convert the input analogue audio signals from the microphone array 11 into digital audio signals and provide the digital audio signals to the processor 21.

The apparatus 10 may in some embodiments receive the audio signals from a microphone array not implemented directly on the apparatus. For example the ear worn speaker 33 apparatus in some embodiments may comprise the microphone array. The EWS 33 apparatus may then transmit the audio signals from the microphone array, which may in some embodiments be received by the transceiver. In some further embodiments the apparatus 10 may receive a bit stream with captured audio data from microphones implemented on another electronic device via the transceiver 13.

In some embodiments, the processor 21 may execute the augmented reality application code stored in the memory 22. The processor 21 in these embodiments may process the received audio signal data and output the processed audio data. The processed audio data in some embodiments may be a binaural signal suitable for being reproduced by headphones or a EWS system.

The received stereo audio data may in some embodiments also be stored, instead of being processed immediately, in the data section 24 of the memory 22, for instance for enabling a later processing (and presentation or forwarding to still another apparatus). In some embodiments other output audio signal formats may be generated and stored such as mono or multichannel (such as 5.1) audio signal formats.

Furthermore the apparatus may comprise a sensor bank 16. The sensor bank 16 receives information about the environment within which the apparatus 10 is operating and passes this information to the processor 21. The sensor bank 16 may comprise at least one of the following set of sensors.

The sensor bank 16 may comprise a camera module. The camera module may in some embodiments comprise at least one camera having a lens for focusing an image on to a digital image capture means such as a charged coupled device (CCD). In other embodiments the digital image capture means may be any suitable image capturing device such as complementary metal oxide semiconductor (CMOS) image sensor. The camera module further comprises in some embodiments a flash lamp for illuminating an object before capturing an image of the object. The flash lamp is linked to a camera processor for controlling the operation of the flash lamp. The camera may be also linked to a camera processor for processing signals received from the camera. The camera processor may be linked to camera memory which may store program codes for the camera processor to execute when capturing an image. The implemented program codes (not shown) may in some embodiments be stored for example in the camera memory for retrieval by the camera processor whenever needed. In some embodiments the camera processor and the camera memory are implemented within the apparatus processor 21 and memory 22 respectively.

Furthermore in some embodiments the camera module may be physically implemented on the ear worn speaker apparatus 33 to provide images from the viewpoint of the user. For example in some embodiments the at least one camera may be positioned to capture images approximately in the eye-line of the user. In some other embodiments at least one camera may be implemented to capture images out of the eye-line of the user, such as to the rear of the user or to the sides of the user. In some embodiments the configuration of the cameras is such to capture images completely surrounding the user—in other words providing 360 degree coverage.

In some embodiments the sensor bank 16 comprises a position/orientation sensor. The orientation sensor in some embodiments may be implemented by a digital compass or solid state compass. In some embodiments the position/orientation sensor is implemented as part of a satellite position system such as a global positioning system (GPS) whereby a receiver is able to estimate the position of the user from receiving timing data from orbiting satellites. Furthermore in some embodiments the GPS information may be used to derive orientation and movement data by comparing the estimated position of the receiver at two time instances.

In some embodiments the sensor bank 16 further comprises a motion sensor in the form of a step counter. A step counter may in some embodiments detect the motion of the user as they rhythmically move up and down as they. walk. The periodicity of the steps may themselves be used to produce an estimate of the speed of motion of the user in some embodiments. In some further embodiments of the application, the sensor bank 16 may comprises at least one accelerometer and/or gyroscope configured to determine and change in motion of the apparatus. The motion sensor may in some embodiments be used as a rough speed sensor configured to estimate the speed of the apparatus from a periodicity of the steps and an estimated stride length. In some further embodiments the step counter speed estimation may be disabled or ignored in some circumstances—such as motion in a vehicle such as a car or train where the step counter may be activated by the motion of the vehicle and therefore would produce inaccurate estimations of the speed of the user.

In some embodiments the sensor bank 16 may comprise a light sensor configured to determine if the user is operating in low-light or dark environments. In some embodiments the sensor bank 16 may comprise a temperature sensor to determine the environment temperature of the apparatus. Furthermore in some embodiments the sensor bank 16 may comprise a chemical sensor or 'nose' configured to determine the presence of specific chemicals. For example the chemical sensor may be configured to determine or detect concentrations of carbon monoxide or carbon dioxide.

In some other embodiments the sensor bank 16 may comprise an air pressure sensor or barometric pressure sensor configured to determine the atmospheric pressure the apparatus is operating within. Thus for example the air pressure sensor may provide a warning or forecast of stormy conditions when detecting a sudden pressure drop.

Furthermore in some other embodiments the 'sensor' and the associated 'sensor input' for providing context related processing may any suitable input capable of producing a context change. For example in some embodiments the sensor input may be provided from the microphone array and the microphone which then may produce context related changes to the audio signal processing. For example in such embodiments the 'sensor input' may be a sound pressure level output signal from a microphone and for example provide a context related processing of other microphone signals in order to cancel out wind noise.

In some other embodiments the 'sensor' may be the user interface, and a 'sensor input' such as described hereafter to produce a context sensitive signal may be an input from user such as a selection on the phone menu. For example when engaging in a conversation with one person while listening to another the user may select and thus provide a sensor input to beamform the signal from a first direction and output the beamformed signal to the playback speakers and to beamform the audio signal from a second signal and record the second direction beamformed signal. Similarly the user interface input may be used to 'tune' the context related processing and provide some manual or semi-automatic interaction.

Figure 2:
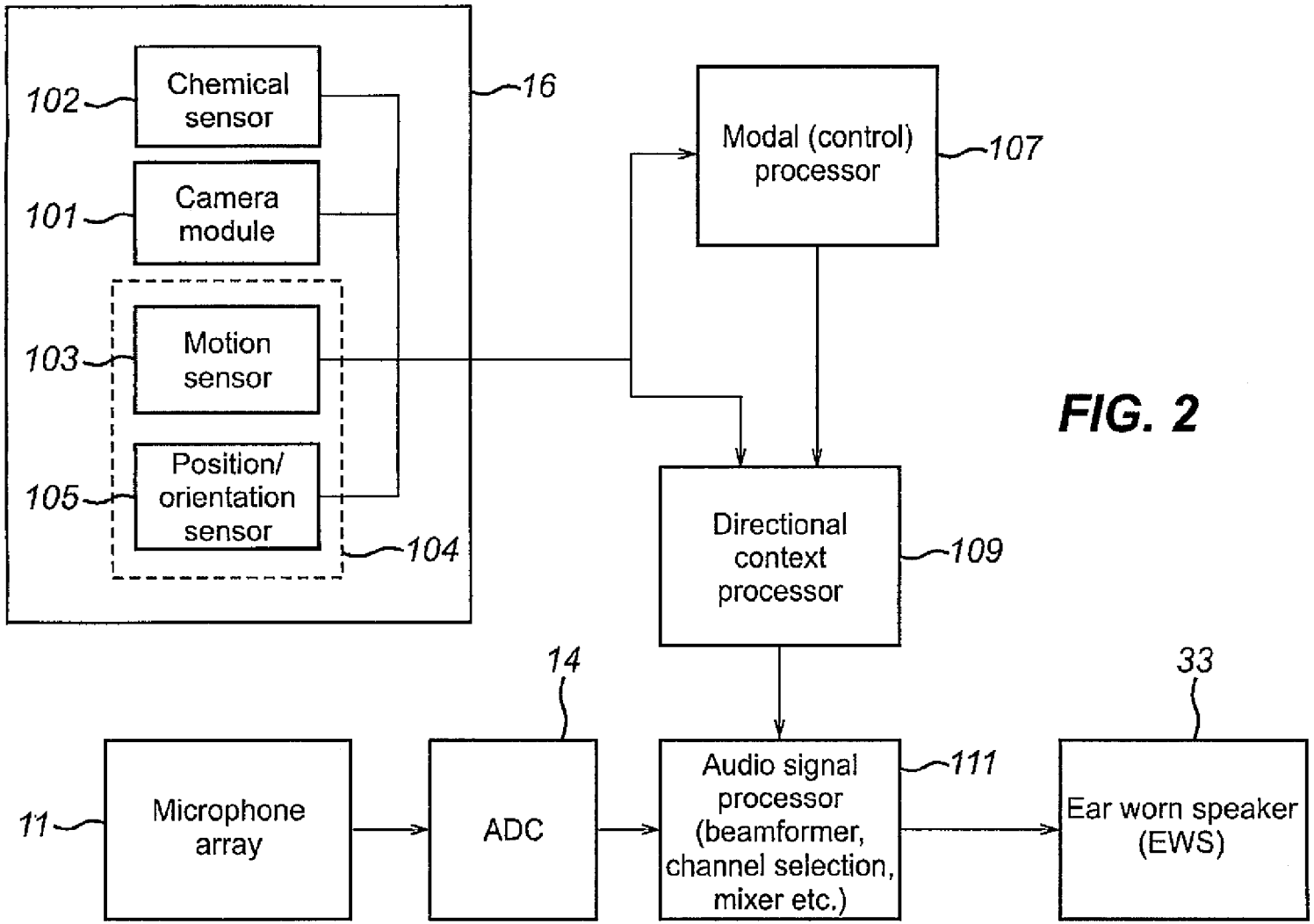
FIG. 2 shows schematically the electronic device shown in FIG. 1 in further detail.
Figure 3:
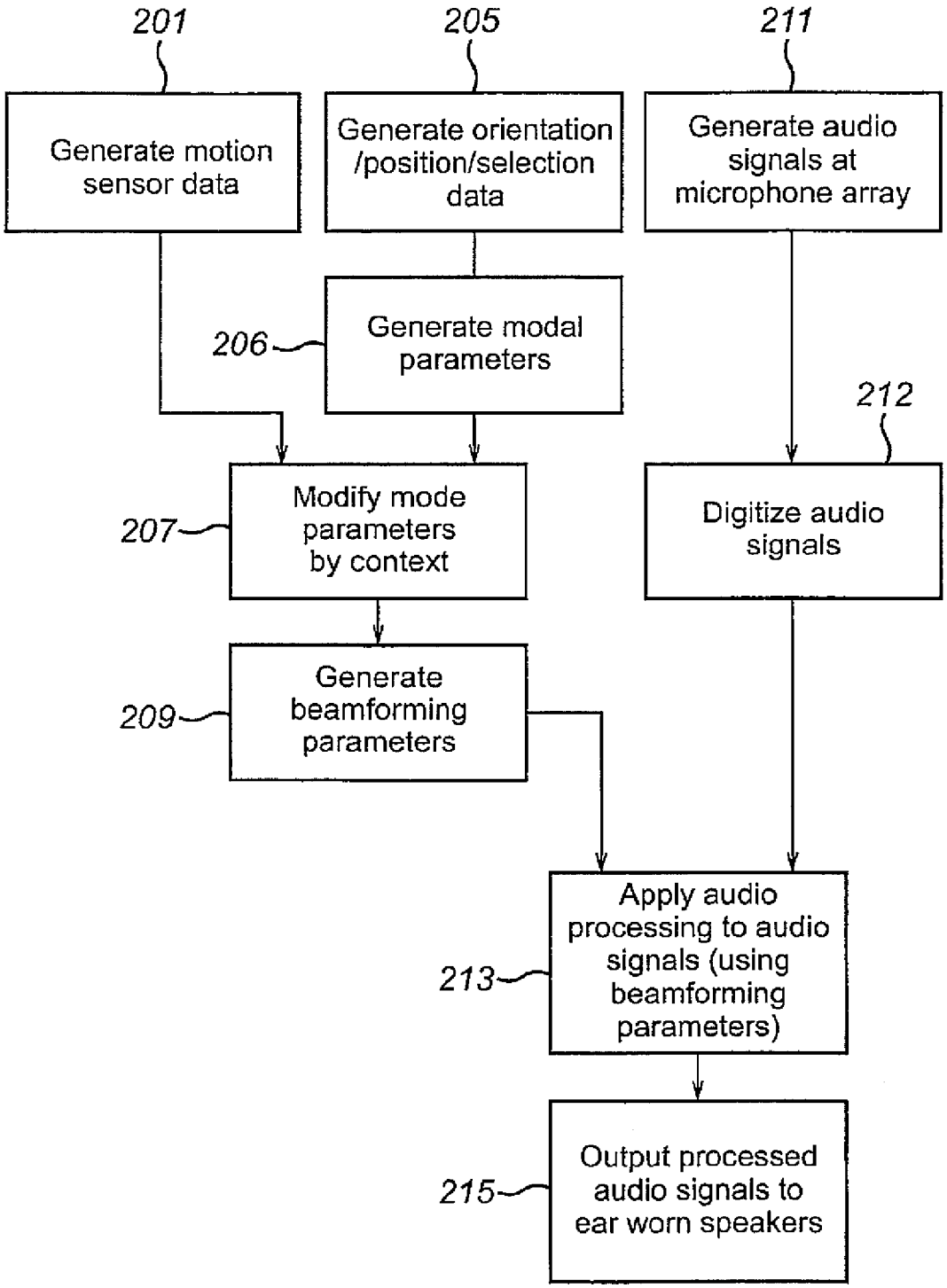
FIG. 3 shows schematically a flow chart illustrating the operation of some embodiments of the application.

It would be appreciated that the schematic structures described in FIG. 2 and the method steps in FIG. 3 represent only a part of the operation of a complete audio processing chain comprising some embodiments as exemplarily shown implemented in the apparatus shown in FIG. 1, in particular the following schematic structures do not describe in detail the operation of auralization and the perception of hearing in terms of the localized sounds from different sources. Furthermore the following description does not detail the generation of binaural signals for example using head related transfer functions (HRTF) or impulse response related functions (IRRF) to train the processor to generate audio signals calibrated to the user. However such operations are known by the person skilled in the art.

With respect to FIG. 2 and FIG. 3 some examples of embodiments of the application as implemented and operated are shown in further detail.

Furthermore these embodiments are described with respect to a first example where the user is using the apparatus in a noisy environment in order to have a conversation with another person wherein the audio processing is beamforming the received audio signals dependent on the sensed context. It would be appreciated that in some other embodiments the audio processing may be any suitable audio processing of the received audio signals or any generated audio signal as will be described also hereinafter.

Figure 4:
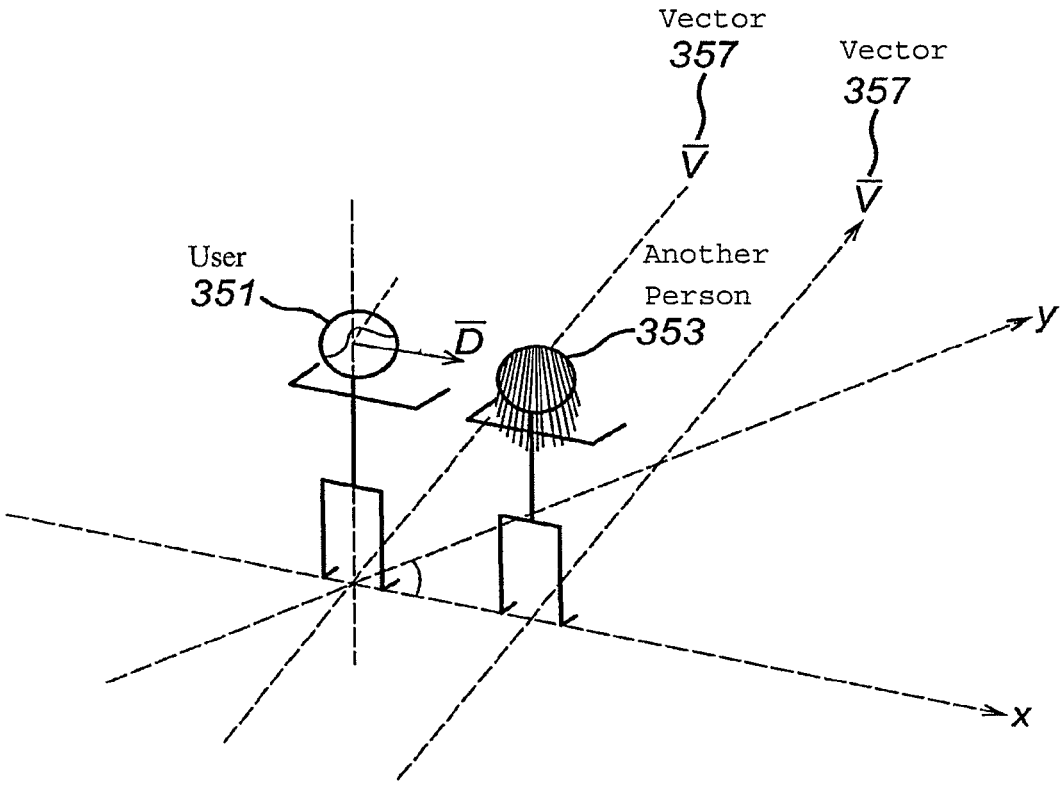
FIG. 4 shows schematically a first example of embodiments of the application.

A schematic view of a context sensitive beamforming is shown with respect to FIG. 4. In FIG. 4 the user 351 equipped with the apparatus attempts to have a conversation with another person 353. The user is orientated, at least with respect to the user's head in a first direction D which is the line between the user and the other person and is moving in a second direction at a speed (both the speed and second direction are represented by the vector V 357).

The sensor bank 16 as shown in FIG. 2 comprises a chemical sensor 102, a camera module 101, and a GPS module 104. The GPS module 104 further comprises in these embodiments a motion sensor/detector 103 and a position/orientation sensor/detector 105.

As described above in some other embodiments the sensor bank may comprise more or fewer sensors. The sensor bank 16 is configured in some embodiments to output sensor data to the modal or control processor 107 and also to the directional or context processor 109.

Using the example in some embodiments the user may for example turn to face the other person involved in the conversation and to initiate the augmented reality mode. The GPS module 104 and particularly the position/orientation sensor 105 may thus determine an orientation of the first direction D which may be passed to the modal processor 107.

In some embodiments further indications may be received of the direction the apparatus is to focus on, i.e. the direction of the other person in the proposed dialogue. For example in some embodiments the apparatus may receive a further indicator by detecting/sensing in input from the user interface 15. For example the user interface (UI) 15 receives an indication of the direction the user wishes to focus on. In other embodiments the direction may be determined automatically for example where the sensor bank 16 comprises further sensors capable of detecting other users and their position to the apparatus the 'other user' sensor may indicate the relative position of the nearest user. In other embodiments, for example in low visibility environments, the 'other user' sensor information may be displayed by the apparatus and then the other person selected by use of the UI 15.

The generation of sensor data for example orientation/position/selection data in order to provide an input to the modal processor 107 is shown in FIG. 3 by step 205.

The modal processor 107 in some embodiments is configured to receive the sensor data from the sensor bank 16, and further in some embodiments selection information from the user interface 15 and then to process these inputs to generate output modal data which is output to the context processor 109.

Figure 5:
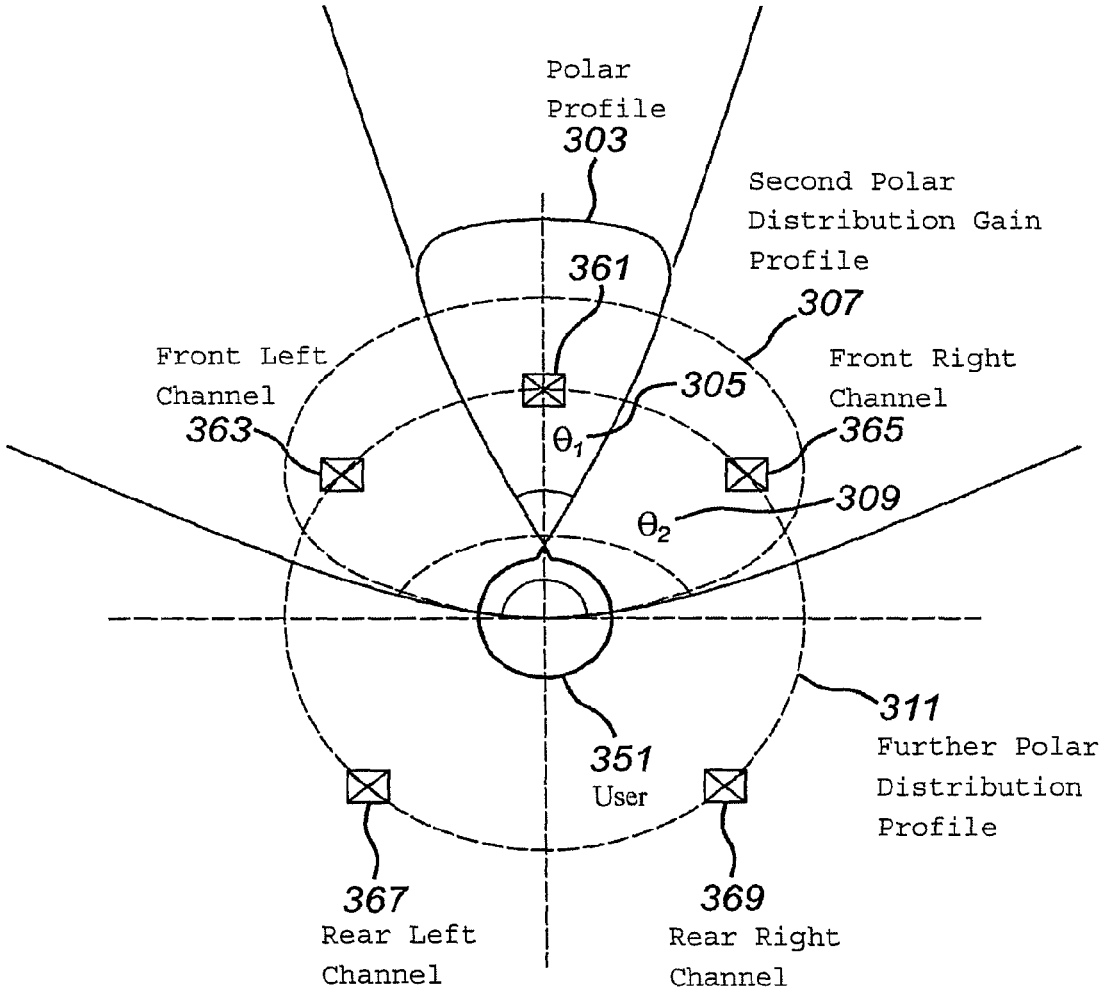
FIG. 5 shows schematically head related spatial configurations suitable for employing in some embodiments of the application.

The modal processor 107 may using the above example receive orientation/position selection data which indicates that the user wishes to talk to or listen to another person in a specific direction. The modal processor 107 may then on receiving these inputs generate modal parameters which indicate a narrow high gain beam processing is to be applied to the audio signals received from the microphone array in the indicated direction. For example as shown in FIG. 5 the modal processor 107 may generate modal parameters for beamforming the received audio signals using a first polar distribution gain profile 303—a high gain, narrow beam in the direction of the user 361.

In some embodiments, as described above, the modal parameters may be output to the context processor 109. In some other embodiments the modal parameters are output directly to the audio signal processor 111 (which for the present example may be implemented by a beamformer).

The generation of the modal parameters is shown in FIG. 3 by step 206.

The context processor is further configured to receive information from the sensors 16, and the modal parameters output from the modal processor 107 and then output processed modal parameters to the audio signal processor 111 based on the sensor information.

Using the above 'conversation' example the GPS module 104 and specifically the motion sensor 103 may determine that the apparatus is static or moving very slowly. In such an example the apparatus determines that the speed is negligible and may output the modal parameters as input. In other words the output from the context processor 109 may be parameters which when received by the audio processor 111 performs a high gain narrow beam in the specified direction.

Using the same example, where the sensors 16 determine that the apparatus is in motion and therefore the user may be in danger of having an accident. For example the user operating the apparatus may be looking in one direction at the other person in the conversation but moving in a second direction at speed (as shown in FIG. 3 by vector V). This motion sensor information may be passed to the context processor 109.

The generation of the motion sensor data is shown in FIG. 3 by step 201.

The context processor 109 in some embodiments on receiving the motion sensor data may determine whether the motion sensor data has an effect on the received modal parameters. in other words whether the sensed (or additionally sensed) information modifies contextually the modal parameters.

Using the example shown in FIG. 3 the context processor may determine the speed of the user and/or the direction of the motion of the user as the factors which contextually modify the modal parameters.

For example, and also described earlier, the context processor 109 may receive sensor information from the sensors 16 that the apparatus (the user) is moving at a relatively slow speed. As the probability of the user colliding with a third party such as a further person or vehicle is low at such a speed the context processor 109 may pass the modal parameters unmodified or with only a small modification.

In some other embodiments the context processor 109 may furthermore use not only absolute speed but also relative direction to the direction faced by the apparatus. Thus in these embodiments the context processor 109 may receive sensor information from the sensors 16 that the apparatus (the user) is moving in the direction that the apparatus is orientated (the direction the user is facing). In such embodiments the context processor 109 may also not modify the modal parameters or only provide minor modification to the parameters as the probability of the user colliding with a third party such as a further person or vehicle is low as the user is likely to see any possible collision or trip hazards.

In some embodiments the context processor 109 may receive sensor information from the sensors 16 that the apparatus (the user) is moving quickly or not facing in the direction that the apparatus is moving, in such embodiments the context processor 109 may modify the modal parameters as the probability of collision is higher.

In some embodiments the context processor 109 modification may be a continuous function. For example the higher the speed and/or the greater the difference between the orientation of the apparatus and the direction of motion of the apparatus the greater the modification. In some other embodiments the context processor may generate discrete modifications which are determined when the context processor 109 determines that a specific or predefined threshold value has been met. For example the context processor 109 may perform a first modification if the context processor 109 determines that the apparatus is moving at a speed faster than 4 km/h and a further modification if the apparatus is moving at a speed more than 8 km/h.

In the example provided above, and shown in FIG. 5, the modal processor 107 may generate modal parameters which would indicate a first polar distribution gain profile 303 with a high gain narrow beam (with a directional spread of $\theta_1$ 305). Using the above threshold example, where the context processor 109 determines that the speed is below the first threshold of 4 km/h the context processor outputs the same modal parameters. On determining that the apparatus is moving a speed greater than 4 km/h the context processor 109 may generate a modification to the modal parameters which broadens the scope but lowers the gain of the first polar distribution gain profile 303 to generate modified modal parameters representing a second polar distribution gain profile 307 with a directional spread of $\theta_2$ 309. Furthermore when the context processor 109 determines that the risk of collision is higher, for example the apparatus is moving at 8 km/h or greater then a further context modification value may further broaden and flatten the gain to produce a further polar distribution profile 311 which has a constant gain for all directions.

The modified modal parameters may then be passed to the audio signal processor 111.

The modification of the modal parameters by the context is shown in FIG. 3 by step 207.

In some embodiments the contextual processor 109 is implemented as part of the audio signal processor 111. In other embodiments the contextual processor 109 and modal processor 107 are implemented together with the output of these embodiments being passed directly to the audio signal processor 111.

Although the above example is one where velocity is the modifying factor on the mode of operation standard parameters it would be appreciated that the modification of the modal parameters by the context processor 109 may be performed based on any suitable detectable phenomenon. For example with respect to the chemical sensor 102 the context processor 109 may modify the beamforming indications when a dangerous level of toxic (for example CO) or suffocating gas (for example $CO_2$) is detected so that the apparatus does not prevent the user from hearing any warnings broadcast. In some other embodiments the beamforming may similarly be modified with the introduction of stored audio warnings or warnings received for example over the wireless communications system and via the transceiver.

The context processor 109 in some embodiments may receive image date from the camera module 101 and determine other hazards. For example the context processor may determine a step in a low light environment and modify the audio processing dependent on the hazard or context identified.

In the above and following example the context processor 109 modifies the modal parameters in light of the sensed information by modifying the audio processing in beamforming modification. In other words the context processor 109 modifies. the modal parameters to instruct or indicate a beamforming processing which is less directed than the processing initially selected for the primary goal. For example the high gain narrow beam may be modified to provide a wide beam gain audio beam. However it would be appreciated that any suitable processing of the modal parameters may be performed dependent on the sensor information.

In some embodiments the context processor 109 modification may indicate or instruct the audio signal processor 111 to mix the microphone captured audio signal with some other audio in a proportion also controlled by the modified modal parameters. For example the context processor 109 may output a processed modal signal instructing the audio signal processor 111 to mix into the captured audio signal a further audio signal. The further audio signal may be a previously stored signal such as a stored warning signal. In some other embodiments the further audio signal may be a received signal such as a short range wireless transmitted audio signal sent to the apparatus to inform the user of the apparatus. In some other embodiments the further audio signal may be a synthesized audio signal which may be triggered from the sensor information.

For example the audio signal may be a synthesized voice providing directions to a requested destination. In some other embodiments the other audio signal may be information on local services or special offers/promotional information when the apparatus is in a predefined location and/or is orientated in a specific direction. This information may indicate to the user of the apparatus areas of danger. For example the apparatus may relay to the user information if there has been reports of pickpockets, muggings or clip joints in the area to provide a warning to the user to be aware of such occurrences.

In some embodiments the modal processor and/or context processor 109 may receive sensor 16 inputs from more than one source and be configured to select indicators from different sensors 16 dependent on the sensor information. For example in some embodiments the sensor 16 may comprise both a GPS type position/motion sensor and also a 'step' position/motion sensor. In such embodiments the modal processor 107 and/or context processor 109 may select the data received from the 'step' position/motion sensor when the GPS type sensor fails to output signals (for example when the apparatus is used indoors or underground), and select data received from the GPS type sensor when the 'step' type sensor output differs significantly from the GPS type sensor output (for example when the user is in a vehicle and the GPS type sensor outputs correct estimates but the 'step' type sensor does not.

The modal processor 107 and the context processor 109 may be implemented in some embodiments as programmes/applications or parts of the processor 21.

The microphone array 11 is further configured to output audio signals from each of the microphones within the microphone array 11 to the Analogue to Digital Converter (ADC) 14.

The microphone array 11 in such embodiments captures the audio input from the environment and generates audio signals which are passed to the audio signal processor 111 via the ADC 14. in some embodiments the microphone array 11 is configured to supply the captured audio signal from each microphone of the array. In some other embodiments the microphone array 11 may comprise microphones which output a digital rather than analogue representation of the audio signal. Thus In some embodiments each microphone in the microphone array 11 comprises an integrated digital to analogue converter, or comprises a pure digital microphone.

In some embodiments the microphone array 11 may furthermore indicate to at least the audio signal processor 111 the position of each microphone and the acoustic profile of the microphone—in other words the microphone's directivity.

In some other embodiments the microphone array 11 may capture the audio signals generated by each microphone and generate a mixed audio signal from the microphones. For example microphone array may generate and output a front left, front right, front centre, rear left and rear right channels which are generated from the audio signals from the microphone array microphone channels. Such a channel configuration is shown in FIG. 5, where virtual front left 363, front right 365, front centre 361, rear left 367 and rear right 369 channel locations are shown.

The generation/capture of the audio signals is shown in FIG. 3 by step 211.

The ADC 14 may be any suitable ADC configured to output to the audio signal processor 111 a suitable digital format signal to be processed.

The analogue to digital conversion of the audio signal is shown in FIG. 3 by step 212.

The audio signal processor 111 is configured to receive both the digitized audio signals via the ADC 14 from the microphone array 11 and the modified modal selection data to process the audio signals. In the following examples the processing of the audio signals is by performing a beamforming operation.

The audio signal processor 111 may on receiving the modal parameters determine or generate a set of beamforming parameters. The beamforming parameters may themselves comprise an array of at least one of a gain function, a time delay function and a phase delay function to be applied to the received/captured audio signals. The gain and delay functions may be based on the knowledge of the position of the received audio signals.

The generation of beamforming parameters is shown in FIG. 3 by step 209.

The audio signal processor 111 may then on generation of the beamforming parameters apply the beamforming parameters to the audio signal received. For example, the application of the gain and phase delay functions to each of the received/captured audio signals may be a simple multiplication. In some embodiments this may be applied using an amplification and filtering operation for each of the audio channels.

For example, the beamforming parameters generated from the modal indicator that would indicate a high gain narrow beam such as that shown with polar profile 303 would apply a large amplification value to the virtual front centre channel 361 and a low gain value to the front left 363 and front right 365 channels, and a zero gain to the rear left 367 and rear right 369 channels. Whereas the audio signal processor 111 in response to the modified second polar distribution may generate beamforming parameters which would apply medium gains to the front centre channel 361 front left 363 and front right 365 channels and zero gain to the rear left 367 and rear right 369 channels. Furthermore, the audio signal processor 111 in response to the modified modal parameters instructing the third polar distribution may generate a uniform gain function to be applied to all of the channels.

The application of the beamforming to audio signals is shown in FIG. 3 by step 213.

In some embodiments the audio signal processor 111 as described previously may perform processing on other audio signals (i.e. audio signals other than those captured by the microphone array). For example the audio signal processor 111 may process stored digital media 'mp3' signals or received 'radio' audio signals. In some embodiments the audio signal processor 111 may 'beamform' the stored or received audio signals by implementing a mixing or processing of the audio signals which when presented to the user via headphones or EWS produces the effect of an audio source in a specific direction or orientation. Thus for example the apparatus 10 when replaying a stored audio signal may cause the effect of movement of the audio signal source dependent on the motion (speed, orientation, position) of the apparatus. In such an example the sensors 16 may output to the modal processor 107 indications of a first orientation of the audio source (for example in front of the apparatus and user), and further output to the context processor 109 indicators of the apparatus speed and further position and orientation which then 'modifies' the original modal parameters (so that the faster the apparatus and user move the further to the rear the audio signal originates). The processed modal parameters being then output to the audio signal processor 111 where the "beamforming" is performed on the audio signal to be output.

In some embodiments the audio signal processor 111 may further separate from the stored or received audio signals components from the audio signal, for example by using frequency or spatial analysis on a music audio signal the vocalist and instrumental parts may be separated and "beamforming" (in other words perceptual orientation processing) dependent on information from the sensors 16 may be performed on each of the separated components.

In some further embodiments of the application the modal processor 107 may generate modal parameters which are processed by the context processor 109 dependent on sensor information which when passed to the audio signal processor 111 may perform an 'active' steering processing of the audio signals from the microphones. In such embodiments ambient or diffuse audio (noise) signals are suppressed but audio signals from discrete sources are passed to the user of the apparatus by the audio signal processor 111 performing a high gain narrow beam in the direction of the discrete audio source or sources. In some embodiments the context processor 109 may process the modal parameters changing the orientation/direction of the beams dependent on the new position/orientation updates of the apparatus (in other words the apparatus compensates for any relative motion of the user and the audio source). Similarly in some embodiments the sensors 16 may indicate the motion of the audio source and similarly the context processor 109 process the modal parameters to maintain a 'lock' on the audio signal source.

The audio signal processor 111 may in some embodiments furthermore downmix the processed audio channels to produce a left and right channel signal suitable for presenting to the headset or ear worn speakers (EWS) 33. The downmixed audio signals may then be output to the earworn speakers.

The outputting of the processed audio signals to the ear worn speakers (EWS) 33 is shown in FIG. 3 by step 215.

In such embodiments as described above the apparatus would present the user with a wider range of auditory cues to assist the user avoid the risk of collision/hazard as the user is moving.

Thus the embodiments of the application attempt to improve the user's perception of the environment and the context within which the user is operating.

Figure 6:
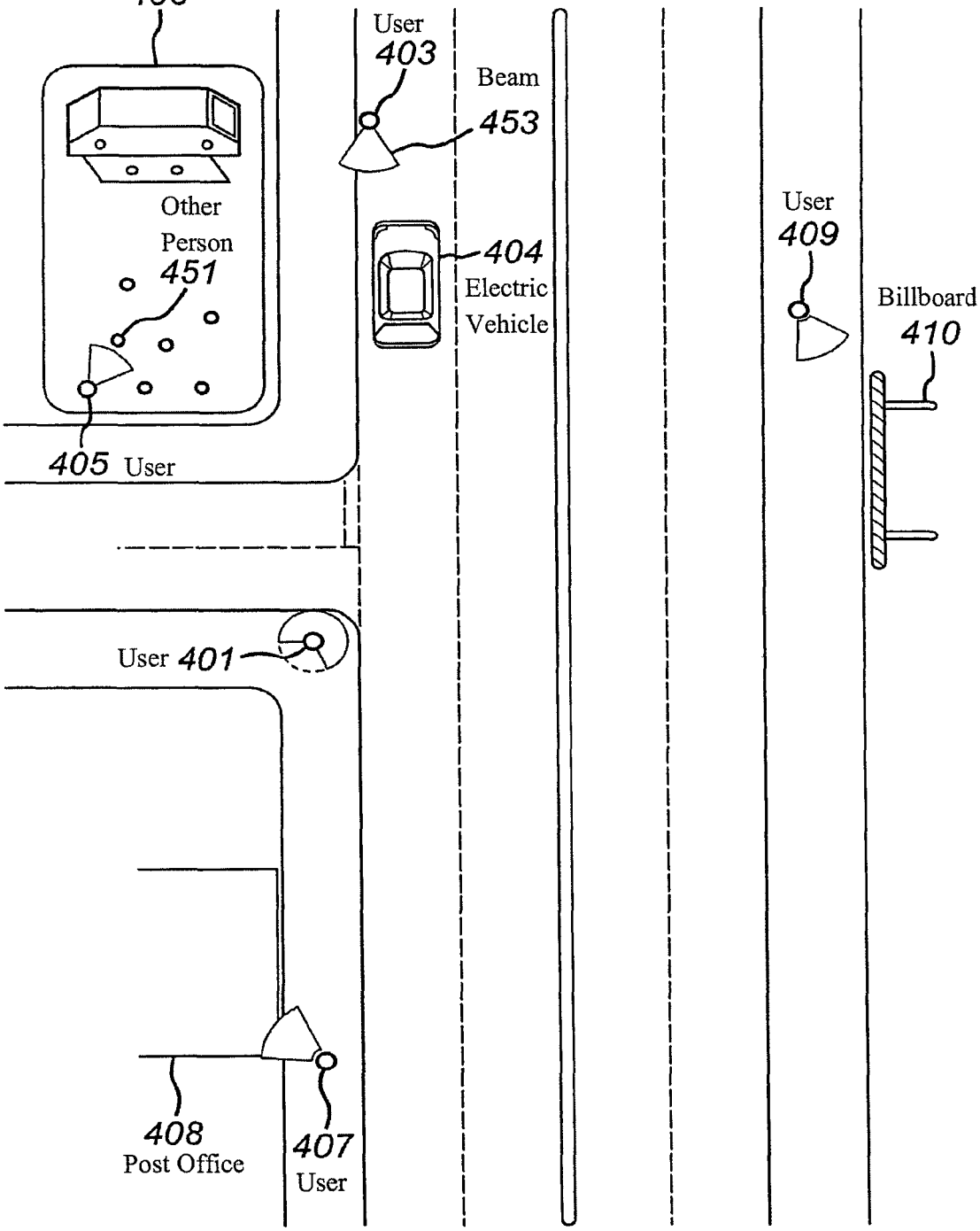
FIG. 6 shows schematically some environments and real world applications suitable for some embodiments of the application.

With regards to FIG. 6, some real world applications of embodiments are shown.

The augmented hearing for conversation application may in some embodiments be used not only in industrial areas but for example and as shown in FIG. 6 by the apparatus of user 405 engaging in a conversation in a noisy environment such as a music concert 406. If the user moves then the context processor 109 may change the gain profile in order that the user can hear auditory cues around the user and avoid collisions with other people 451 and objects.

A further application may be the control of ambient noise cancellation in an urban environment. When the context processor 109 of the apparatus used by user 401 detects that the apparatus is reaching a busy road junction, for example by the GPS position/orientation sensor 105 position coupled with knowledge of the local road network then the gain profile for ambience noise reduction may be specifically reduced for directions which the apparatus determines that traffic will arrive from. Thus, for example shown in FIG. 6 the apparatus used by user 401 reduces the ambience noise cancellation for the region to the front and rear right quadrant of the user (the context processor 109 determining that traffic is not likely to approach from the rear left.

The apparatus for a user 403 cycling along a road with the apparatus may be operating the apparatus in a non-visible hazard detection mode with rearward facing beam 453. For example as shown in FIG. 6, the apparatus 10 used by the user 403 may detect the electric vehicle 404 approaching from the rear of the apparatus. In some embodiments this detection may be using a camera module as part of the sensors, while in some other embodiments the electric vehicle may be transmitting a hazard indicator signal which is received by the apparatus. The context processor may then modify the modal parameters to instruct the audio signal processor 111 to process the audio signal to be output to the user. For example in some embodiments the beamformer/audio processor may perform a beamforming of the vehicle sound to enhance the low volume levels and prevent the user from being spooked if the electric vehicle passes too closely. In some other embodiments the audio signal processor may output a warning message to prevent the user from being spooked if the electric vehicle passes too closely.

In some further embodiments, the auditory processing may be organised to assist the user in reaching a destination or assisting those with visual disabilities. For example, the apparatus used by user 407 may attempting to assist the user find the post office shown as reference 408. The post office may broadcast a low level auditory signal which may indicate if there would be any difficulty entering the building, such as steps. Furthermore in some embodiments the audio signal processor 111 under instruction from the context processor 109 may narrow and orientate the beam thus providing an auditory cue for the entrance of the building. Similarly, the context processor of a user 409 passing a billboard 410 may process the audio signal—which may be a received microphone signals or a audio signal to be passed to the EWS (for example a MP3 or similar audio signal) to generate a beam directing the user to look at the billboard. In some further embodiments the context processor may instruct the audio processor to relay audio information concerning the products or information on the billboard received via the transceiver as the apparatus passes the billboard.

Although the above examples describe embodiments of the invention operating within an electronic device 10 or apparatus, it would be appreciated that the invention as described below may be implemented as part of any audio processor.

Thus, for example, embodiments of the invention may be implemented in an audio processor which may implement audio processing over fixed or wired communication paths.

Thus user equipment may comprise an audio processor such as those described in embodiments of the invention above.

It shall be appreciated that the term electronic device and user equipment is intended to cover any suitable type of wireless user equipment, such as mobile telephones, portable data processing devices or portable web browsers.

In general, the various embodiments of the invention may be implemented in hardware or special purpose circuits, software, logic or any combination thereof. For example, some aspects may be implemented in hardware, while other aspects may be implemented in firmware or software which may be executed by a controller, microprocessor or other computing device, although the invention is not limited thereto. While various aspects of the invention may be illustrated and described as block diagrams, flow charts, or using some other pictorial representation, it is well understood that these blocks, apparatus, systems, techniques or methods described herein may be implemented in, as non-limiting examples, hardware, software, firmware, special purpose circuits or logic, general purpose hardware or controller or other computing devices, or some combination thereof.

Thus in at least one embodiments there is an apparatus comprising: a controller configured to process at least one control parameter dependent on at least one sensor input parameter; and an audio signal processor configured to process at least one audio signal dependent on the processed at least one control parameter; wherein the audio signal processor is further configured to output the processed at least one audio signal.

The embodiments of this invention may be implemented by computer software executable by a data processor of the mobile device, such as in the processor entity, or by hardware, or by a combination of software and hardware. Further in this regard it should be noted that any blocks of the logic flow as in the Figures may represent program steps, or interconnected logic circuits, blocks and functions, or a combination of program steps and logic circuits, blocks and functions. The software may be stored on such physical media as memory chips, or memory blocks implemented within the processor, magnetic media such as hard disk or floppy disks, and optical media such as for example DVD and the data variants thereof, CD.

Thus in summary in some embodiments there may be a computer-readable medium encoded with instructions that, when executed by a computer perform: processing at least one control parameter dependent on at least one sensor input parameter; processing at least one audio signal dependent on the processed at least one control parameter; and outputting the processed at least one audio signal.

The memory may be of any type suitable to the local technical environment and may be implemented using any suitable data storage technology, such as semiconductor-based memory devices, magnetic memory devices and systems, optical memory devices and systems, fixed memory and removable memory. The data processors may be of any type suitable to the local technical environment, and may include one or more of general purpose computers, special purpose computers, microprocessors, digital signal processors (DSPs), application specific integrated circuits (ASIC), gate level circuits and processors based on multi-core processor architecture, as non-limiting examples.

Embodiments of the inventions may be practiced in various components such as integrated circuit modules. The design of integrated circuits is by and large a highly automated process. Complex and powerful software tools are available for converting a logic level design into a semiconductor circuit design ready to be etched and formed on a semiconductor substrate.

Programs, such as those provided by Synopsys, Inc. of Mountain View, Calif. and Cadence Design, of San Jose, Calif. automatically route conductors and locate components on a semiconductor chip using well established rules of design as well as libraries of pre-stored design modules. Once the design for a semiconductor circuit has been completed, the resultant design, in a standardized electronic format (e.g., Opus, GDSII, or the like) may be transmitted to a semiconductor fabrication facility or "fab" for fabrication.

As used in this application, the term 'circuitry' refers to all of the following:

(a) hardware-only circuit implementations (such as implementations in only analog and/or digital circuitry) and (b) to combinations of circuits and software (and/or firmware), such as: (i) to a combination of processor(s) or (ii) to portions of processor(s)/software (including digital signal processor(s)), software, and memory(ies) that work together to cause an apparatus, such as a mobile phone or server, to perform various functions and (c) to circuits, such as a microprocessor(s) or a portion of a microprocessor(s), that require software or firmware for operation, even if the software or firmware is not physically present.

This definition of 'circuitry' applies to all uses of this term in this application, including any claims. As a further example, as used in this application, the term 'circuitry' would also cover an implementation of merely a processor (or multiple processors) or portion of a processor and its (or their) accompanying software and/or firmware. The term 'circuitry' would also cover, for example and if applicable to the particular claim element, a baseband integrated circuit or applications processor integrated circuit for a mobile phone or similar integrated circuit in server, a cellular network device, or other network device.

The foregoing description has provided by way of exemplary and non-limiting examples a full and informative description of the exemplary embodiment of this invention. However, various modifications and adaptations may become apparent to those skilled in the relevant arts in view of the foregoing description, when read in conjunction with the accompanying drawings and the appended claims. However, all such and similar modifications of the teachings of this invention will still fall within the scope of this invention as defined in the appended claims.

The invention claimed is:

1. A method comprising:

generating at least one control parameter by one or more processors, where the generating of the at least one control parameter is based, at least partially, upon at least one first input parameter;

selecting a mode by one or more processors from a plurality of modes, where at least one of the modes is configured to modify the at least one control parameter, where the selecting of the mode is based, at least partially, upon at least one second input parameter, where at least one of the first and second input parameters are from at least one sensor;

processing at least one sensory information signal based, at least partially, upon the generated at least one control parameter and the selected mode; and outputting the processed at least one sensory information signal.

2. The method as claimed in claim 1 where the at least one sensory information signal comprises an audio signal.

3. The method as claimed in claim 1 where the at least one control parameter comprises at least one of:

a gain and delay value;

a beamforming beam gain function;

a beamforming beam width function;

a beamforming beam orientation function;

a perceived orientation beamforming gain; and a beam width parameter.

4. The method as claimed in claim 1 where the generating of the at least one control parameter is based, at least partially, upon at least two first input parameters from at least two of the sensors.

5. The method as claimed in claim 1 wherein processing of the at least one sensory information signal comprises beamforming.

6. The method as claimed in claim 1 where the at least one first input parameter comprises a signal from at least one of the sensors, and where the at least one second input parameter comprises a signal from at least one different one of the sensors.

7. The method as claimed in claim 1 where at least one of the modes is configured to not modify the at least one control parameter.

8. The method as claimed in claim 1 where the sensory information signal comprises a signal from a sensor, where the signal from the sensor is processed based, at least partially, upon the generated at least one control parameter and the selected mode.

9. The method as claimed in claim 1 where the sensory information signal comprises a sensor signal retrieved from a non-transitory memory and/or received in a wireless transmission, where the sensor signal is processed based, at least partially, upon the generated at least one control parameter and the selected mode.

10. The method as claimed in claim 1 where the generating of the at least one control parameter by the one or more processors and the selecting of the mode by the one or more processors are done, at least partially, with a common processor.

11. The method as claimed in claim 6 where the at least one first input parameter and the at least one second input parameter are at least partially different.

12. The method as claimed in claim 11 where the at least one first input parameter comprises location information from a location sensor.

13. An apparatus comprising:

at least one processor; and at least one non-transitory memory including computer program code, the at least one non-transitory memory and the computer program code configured to, with the at least one processor, causes the apparatus at least to:

generate at least one control parameter, where the at least one control parameter is based, at least partially, upon at least one first input parameter;

select a mode from a plurality of modes, where at least one of the modes is configured to modify the at least one control parameter, where the selecting of the mode is based, at least partially, upon at least one second input parameter, where at least one of the first and second input parameters are from at least one sensor;

processing at least one sensory information signal based, at least partially, upon the generated at least one control parameter and the selected mode; and outputting the processed at least one sensory information signal.

14. The apparatus as claimed in claim 13 where the at least one sensory information signal comprises an audio signal.

15. The apparatus as claimed in claim 13 where the at least one control parameter comprises at least one of:

a gain and delay value;

a beamforming beam gain function;

a beamforming beam width function;

a beamforming beam orientation function;

a perceived orientation beamforming gain; and a beam width parameter.

16. The apparatus as claimed in claim 13 where the generating of the at least one control parameter is based, at least partially, upon at least two first input parameters from at least two of the sensors.

17. The apparatus as claimed in claim 13 where the processing of the at least one sensory information signal comprises beamforming.

18. The apparatus as claimed in claim 13 where the at least one first input parameter comprises a signal from at least one of the sensors, and where the at least one second input parameter comprises a signal from at least one different one of the sensors.

19. The apparatus as claimed in claim 13 where the at least one first input parameter comprises location information from a location sensor.

20. The apparatus as claimed in claim 13 where at least one of the modes is configured to not modify the at least one control parameter.

21. The apparatus as claimed in claim 13 where the sensory information signal comprises a signal from a sensor, where the signal from the sensor is processed based, at least partially, upon the generated at least one control parameter and the selected mode.

22. The apparatus as claimed in claim 18 where the at least one first input parameter and the at least one second input parameter are at least partially different.

23. A non-transitory program storage device readable by a machine, tangibly embodying a program of instructions executable by the machine for performing operations, the operations comprising:

generating at least one control parameter by one or more processors, where the generating of the at least one control parameter is based, at least partially, upon at least one first input parameter;

selecting a mode by one or more processors from a plurality of modes, where at least one of the modes is configured to modify the at least one control parameter, where the selecting of the mode is based, at least partially, upon at least one second input parameter, where at least one of the first and second input parameters are from at least one sensor;

processing at least one sensory information signal based, at least partially, upon the generated at least one control parameter and the selected mode; and outputting the processed at least one sensory information signal.

* * * * *